US007516590B2

(12) United States Patent
Brinkmann

(10) Patent No.: US 7,516,590 B2
(45) Date of Patent: Apr. 14, 2009

(54) MODULAR HEAVY DUTY SUPPORT SYSTEM

(75) Inventor: Frans Brinkmann, Budel (NL)

(73) Assignee: Scafom International B.V., PZ Budel (NL)

( * ) Notice: Subject to any disclaimer, the term of this patent is extended or adjusted under 35 U.S.C. 154(b) by 176 days.

(21) Appl. No.: 10/522,129

(22) PCT Filed: Jul. 25, 2003

(86) PCT No.: PCT/NL03/00543

§ 371 (c)(1),
(2), (4) Date: Dec. 27, 2005

(87) PCT Pub. No.: WO2004/011741

PCT Pub. Date: Feb. 5, 2004

(65) Prior Publication Data

US 2006/0175129 A1 Aug. 10, 2006

(30) Foreign Application Priority Data

Jul. 31, 2002 (NL) ..... 1021191

(51) Int. Cl.
*E04H 12/00* (2006.01)
*E04H 12/18* (2006.01)

(52) U.S. Cl. ..... 52/651.01; 52/651.06; 52/637; 52/646; 248/150; 248/166; 182/152

(58) Field of Classification Search ..... 52/651.1, 52/651.06, 646, 653.2, 651.01, 651.09, 637, 52/126.1, 126.6, 126.7; 248/150, 166; 182/152, 182/178, 179

See application file for complete search history.

(56) References Cited

U.S. PATENT DOCUMENTS 3,190,405 A * 6/1965 Squire ..... 52/637

(Continued)

FOREIGN PATENT DOCUMENTS

EP 0 549 359 A 6/1993

*Primary Examiner*—Richard E Chilcot, Jr.
*Assistant Examiner*—Mark R Wendell
(74) *Attorney, Agent, or Firm*—Knobbe Martens Olson & Bear LLP

(57) ABSTRACT

The invention relates to a modular HD (Heavy Duty) support system (1) having a strongly increased resistance to breaking strain and strain of flexure for the support of very huge and heavy shuttering for use in modern building. This module comprises vertical upright assembly systems (2) consisting of upright elements (2') with connecting members (3) and intermediate frames (5). The bottom part and/or top part of each upright assembly (2) is provided with a spindle assembly (4), which is capable of carrying a high load and with adjustable butterfly nuts (20) and coupling pieces (21). In upward direction the upright assembly systems (2) are extended by means of connecting pieces (3) provided with locking pins (8*a*, 8*b*) for obtaining a connection which is resistant to tensile strain. In lateral direction the upright assembly systems (2) are intercoupled by means of a coupling assembly comprising a screw member (46) and claws (47, 48) positioned on intermediate frames (5) and also C-shaped coupling members positioned on upright elements (2'), but also on a coupling piece (21) of a spindle assembly (4) for reducing the flexing length thereof. The module (1) is transportable as a whole in assembled position and even in height adjustable under load. The module (1) may be in height and also in width and in length be extended moreover by practically an unlimited number of upright assembly systems (2) and intermediate frames (5).

12 Claims, 19 Drawing Sheets

U.S. PATENT DOCUMENTS 3,565,501 A * 2/1971 Bowen et al. ..... 312/228
4,026,079 A * 5/1977 Morris ..... 52/126.7
4,036,466 A * 7/1977 Van Meter ..... 249/18
4,462,197 A * 7/1984 D'Alessio et al. ..... 52/637
4,741,505 A * 5/1988 Anderson ..... 248/357
4,787,183 A * 11/1988 Johnston ..... 52/126.4
4,841,708 A * 6/1989 Johnston ..... 52/646
5,367,852 A * 11/1994 Masuda et al. ..... 52/651.06
5,388,666 A * 2/1995 Schworer ..... 182/186.6
6,161,359 A 12/2000 Ono

* cited by examiner (19)

(19)

(46)

MODULAR HEAVY DUTY SUPPORT SYSTEM

This invention relates to a modular HD (Heavy Duty) support system constructed from HD (Heavy Duty) support system modules having a strongly increased resistance to breaking strain and strain of flexure for support of very huge and very heavy shuttering for use in modern building. The new modular HD support system consists of at least four vertical upright assembly systems constructed from upright elements and connecting members, spindle assemblies, which can be subjected to high stress, which are provided with spindle nuts and coupling pieces and intermediate frames for interconnecting said coupling elements and intermediate frames and/or spindle assemblies in such a manner that the modular HD support system in assembled position is transportable and adjustable in height respectively. The modular HD support system can be used independently for support of smaller shuttering systems, whereas in itself it may also in height and in width and in length be extended by an unlimited number of upright assembly systems and intermediate frames for support of e.g. very huge, heavy and complexly shaped shuttering.

Shuttering systems of storey floors and ceilings or other essentially sheet shaped concrete elements at a building site are positioned and supported by a suitable support construction during the building process. In modern building practise these support constructions, whereupon contact shuttering is mounted, must minimally comply to a great number of national and/or international buildings standards.

Upright assembly systems of most well known building support systems are provided at its bottom and top parts with height adjustable spindle(s) to preset accurately the total height. In the event that these support systems are used for the above mentioned heavy duty loads, the height adjustable spindles have inadequate load capacity due to impermissible increase of flexing sensitivity when more than 40% of their length must be unscrewed. Too short a free available adjustable length leads automatically to a substantial restriction in flexibility of the support systems on a building site. In other words, in case changes in the floor configuration will occur, caused by several activities and/or possible undesired subsidence's, settlements or the like, there usually will not remain enough available adjustable spindle height for renewed adjustment of the height of an already assembled support system.

When using a modular HD support system constructed from one or more HD support system modules according to the invention these problems are solved. The new modular HD support system is constructed from the following essential elements:

1. at least four stable vertical upright assembly systems each consisting of
   - 1.1. at least one tube-shaped upright element consisting of a relatively heavy shape retaining tube profile which on its outer circumference and all over its length is provided with an plurality of C-shaped coupling members which are positioned regularly on equally but differently distances along the outer circumference or in longitudinal direction respectively;
   - 1.2. at least one relatively heavily tube-shaped coupling member for mutually connecting two upright elements positioned on top of each other into a compact compound element;
   - 1.3. at least one very heavily constructed adjustable spindle assembly resistant being mounted resistantly to tensile strain to the lower and/or to the upper side of an upright assembly, which spindle assembly is provided with a coupling part which is also provided with an plurality of C-shaped coupling members;
2. at least four intermediate frames for mutually interconnecting said stable vertical upright assembly systems, each intermediate frame thereby consisting of:
   - 2.1. two distantly spaced parallel horizontally placed girders interconnected by means of lattice elements or the like, where each of both free ends of a girder is provided with a
   - 2.2. coupling device which connects each of the four free ends of an intermediate frame with an adjacent other vertical upright element and/or spindle assembly thereby using said C-shaped coupling members; in such a manner, that the modular HD support system constructed from modular HD support systems in its assembled position is transportable as a whole and adjustable in height respectively, which modular HD support system can be introduced independently (as a single design) for support of usually smaller shuttering systems, but can also be used respectively whereas in itself it may, also in height and in width be extended and moreover by practically an unlimited number of upright assembly systems and intermediate frames.

An upright element consists of a robust shape-retaining tube profile provided with a large outer diameter of e.g. 135 mm and of a heavy wall thickness of e.g. 6 mm. This upright element is on its outer circumference and over its length provided with a plurality of C-shaped coupling members which are positioned regularly on equally but differently distances along the outer circumference and in longitudinal direction respectively.

A tube-shaped connecting member for mutually intercoupling two upright elements one positioned upon the other consists of a shape-retaining tube profile provided with guiding means for internally mounting into said upright elements.

The connecting member is provided half way its length with a ring having a greater outer diameter than the upright element has, whereby both ends of the connecting member are provided with passing through openings for receiving a specially shaped locking pin, in such a way that the lower end of the lacking member is mounted from the: upside down into an upright element until near the ring, whereafter on its upper end a next upright element is placed. The fixation thereof is effected by means of said, locking pins, which locking pins are of elliptical shape in cross section, and each are provided with a handgrip in such a way that the upright elements can be interconnected with the interconnecting member into a very strong, stable and robust unit. Both locking pins are positioned at a certain mutual distance by means of a perforated rectangular sheet welded upon said ring. This mutual distance corresponds to the mutual distance between the passing through openings on both ends of the connecting member and also to the passing through openings of two upright elements mounted in a position one placed upon the other.

The adjustable spindle assembly comprises essentially a heavy tube-shaped spindle, a foot element, a butterfly nut and a coupling piece whereby the spindle assembly is positioned at the bottom part of the lowest positioned (contact with the ground) upright element or at the top part of the highest positioned (contact with shuttering) upright element.

This spindle is provided with a threading which is capable of carrying high loads, and is further provided at its upper end with guiding strips for the internal concentric positioning and mounting respectively of the spindle in the lower end opening of a tube-shaped upright element. The bottom part of the spindle is provided with means for positioning and anchoring into a foot element comprising a foot plate which at its upper part is provided with two vertical reinforcing sheets welded thereupon, provided with cylindrical openings for receiving a solid round axis (locking pin).

A butterfly nut, mounted on the spindle, comprises a hollow cylindrical housing provided with internal screw-thread cooperating to the threading on the spindle. The bottom side is provided with a plurality of handgrips for the adjusting of the upright assembly at a desired height and also, later on after hardening out of the concrete, for fast dismounting thereof. On its top part a free rotatable ring is mounted, by means of a pivoting connection. This free rotatable ring is provided on its outside with a set of sheet shaped screw holders welded thereto for locking pins for anchoring into the lower or upper end opening of a tube-shaped upright element. This results in mounting the butterfly nut, which is resistant to tensile strain, to the lower or upper side of the upright tube element thereby not blocking the rotation of the butterfly nut.

A coupling piece is also positioned on the spindle to increase its resistance against flexing (the free flexing length of the spindle is so reduced) The coupling piece comprises a hollow cylindrical housing internally provided with guiding strips for its vertical guiding on the spindle. Moreover the coupling piece on its outer circumference is provided with four welded C-shaped coupling members in such a way that in its mounted position one or more intermediate frames may be coupled up on the coupling parts and also on the upright elements and the spindle assemblies thereby considerably reducing the free flexing length of the spindle.

A new coupling assembly is developed for the modular HD support system for mutually interconnecting intermediate frames with upright elements and/or spindle assemblies. This new coupling assembly comprises coupling devices, C-shaped coupling members and, corner struts.

Coupling assemblies each comprising an upper claw, a lower claw, and a screw member, are positioned on all four free ends of the intermediate frames, two at the top and two at the bottom. The upper claw consists of an L-shaped sheet element whereby the longer part of the L is welded onto the free upper end opening of the horizontally positioned girders of an intermediate frame whereas the shorter part of the L is pointing downward. For easy mounting of the intermediate frame upon an upright assembly the upwardly pointing short portion of the L of the upper claw of an upper positioned coupling device is longer than the downwardly pointing shorter portion of the L of the upper claw of a lower positioned coupling device. The lower claw is formed as a loose L-shaped sheet element provided with a cylindrical protrusion provided with internal screw thread. Each lower claw is fixed by means of a screw member against the free lower side of the horizontally positioned girder of an intermediate frame. Girders are, each at a certain distance from their free end openings internally provided with tube element welded therein for positioning and centering respectively of said cylindrical protrusion of the lower claw. The spaces enclosed between the C-shaped coupling members and said upright elements or coupling pieces of the spindle assemblies offer sufficient space for locating therein the upper claw and the lower claw for intercoupling of the intermediate frames thereto. Moreover the corner struts are in an inclined position on two adjacent intermediate frames near the free upper openings thereof by means of the usual connecting means as e.g. a usual wedge coupling or the like, in such a way that each of the four free end openings of an intermediate frame may be connected into a very strong, stable and transportable unit with an adjacent other vertical upright element and/or spindle assembly, while preventing twisting of a single loaded HD support system module or of a complex construction assembled from a plurality of HD support system modules respectively into a very strong and robust as well as a transportable unit.

The invention will now be described, by means of embodiments thereof, with reference to the accompanying drawings 1-36 wherein.

Figure 1:
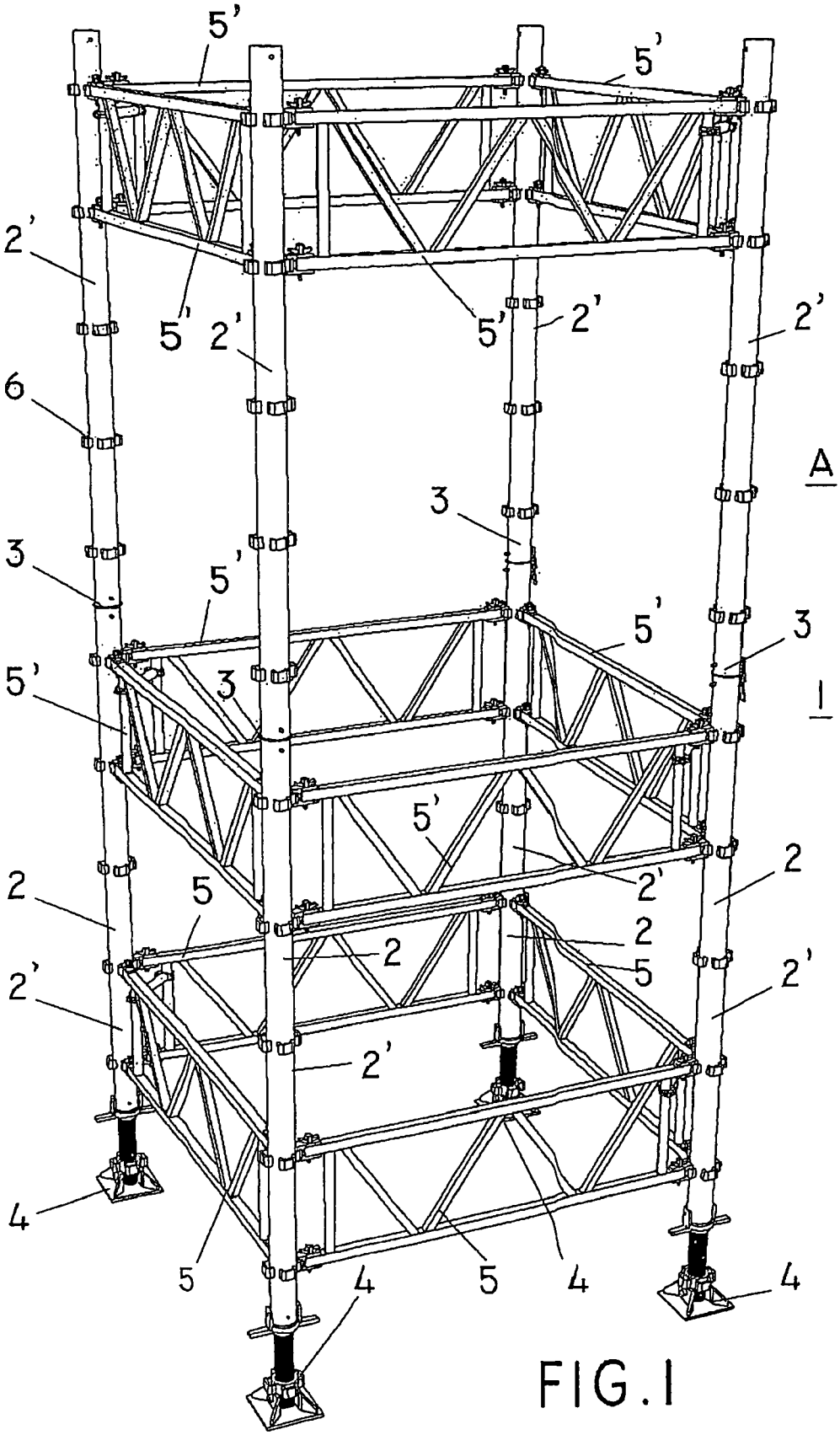
FIG. 1 is a perspective view of the modular HD support system fully mounted.

According to FIG. 1 the modular HD support system 1 consists of four upright assembly systems 2, each comprising upright elements 2', four tube-shaped connecting members 3, four spindle assemblies 4, and four intermediate frames 5, whereby the upright elements 2' and the intermediate frames 5 are mutually coupled by means of the coupling assemblies (not very well visible). The modular HD support system 1 is extended with four-tube-shaped upright elements 2' and also with eight intermediate frames 5' to obtain a complete HD support system A. The shown arrangement (module plus extension) has a total height of approx. 6.5 meter and further is provided with a square shaped base of 2.4 m×2.4 m. Each of the four spindle assemblies is easily manually adjustable in height also after having assembled the HD support system A on a building site, e.g. in an arrangement as shown in FIG. 1, but also further extended with other upright elements 2', connecting parts 3 and intermediate frames 5' until a height of e.g. 50 m and with a base of e.g. 24 m×12 m.

Figure 2:
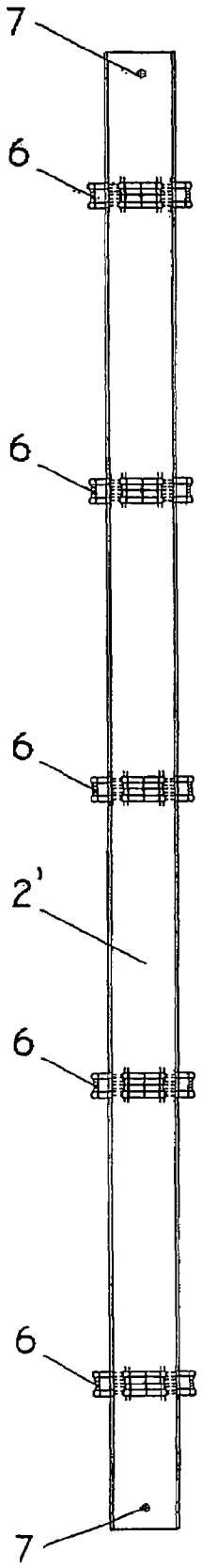
FIG. 2 is a side view of a tube-shaped upright element.
Figure 3:
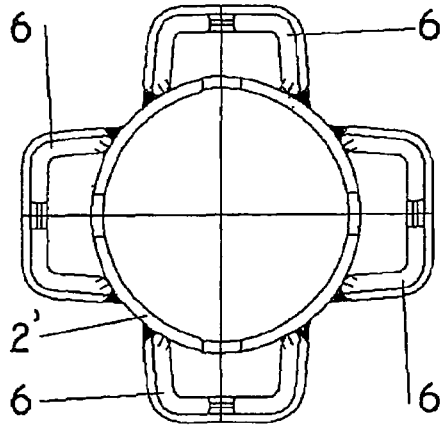
FIG. 3 is a top view of a tube-shaped upright element.

According to FIG. 2 the tube-shaped upright element 2' has a length of approx. 3 m and an external diameter of approx. 135 mm. At a distance of approx. 45 mm of both free ends of the tube-shaped upright element 2' four boreholes are provided for mounting of connecting pieces (not shown). The outside of the tube-shaped upright element 2' is in its longitudinal direction provided with a plurality of C-shaped coupling members 6 at a regular mutual distance of approx. 600 mm. In a top view, as shown in FIG. 3, the C-shaped coupling members 6 are welded together on the outside of the tube-shaped upright element 2' under an angle of 90° with respect to each other.

Figure 4:
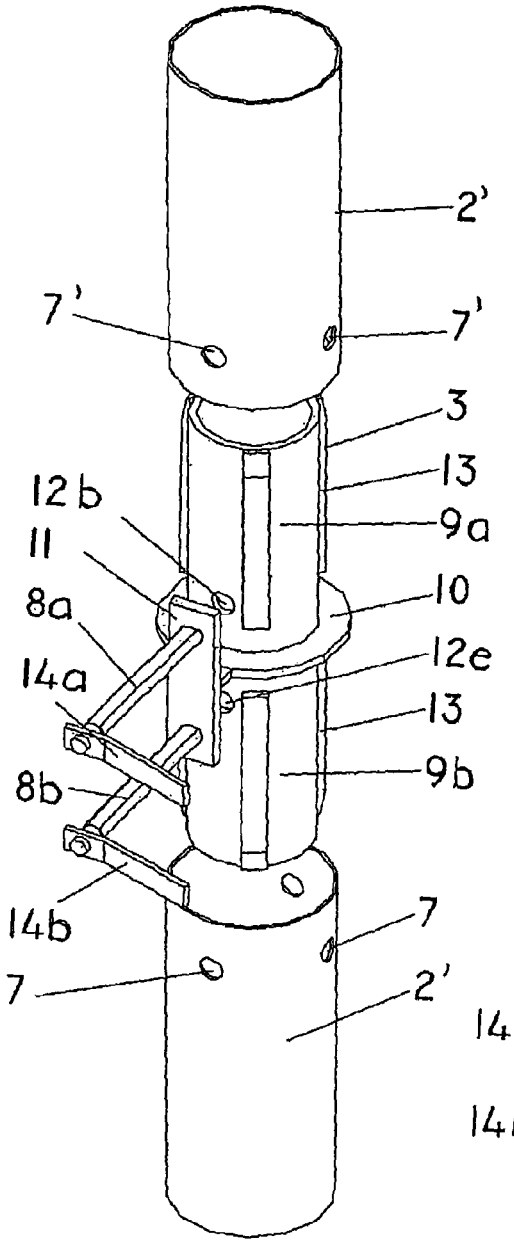
FIG. 4 is a perspective view of a connecting member and two upright elements suitable for intercoupling.

Two upright elements 2' are connected according to FIG. 4 by means of the vertical connecting piece 3. Bottom part 9*b* of connecting piece 3 is mounted from the upside down into the lower upright element 2' Thereafter the upper upright element 2' can be mounted. One should thereby take into account of the alignment of boreholes 7 and 7' of the upright elements 2' in relation to the boreholes 12*a* and 12*b* of connecting piece 3. Connecting piece 3 consists of a tube-shaped upper body 9*a* and of a lower body 9*b* having a round intermediary sheet 10 welded in between, each provided with sheet shaped guiding means 13 for easy positioning or placing upright element 2' into the free ends of the upright elements 2'. Moreover connecting piece 3 is provided with a sheet shaped pin holder 11 for guiding the locking pins 8*a* and 8*b* through boreholes 7 and 7' of both upright elements 2'. The locking pins 8*a* and 8*b* are also guided through the boreholes 12*b* and 12*e* of the connecting piece 3. Fastening of connecting piece 3 between upright elements 2' is realised by rotating downward both locking pins 8*a* and 8*b* under an angle of approx. 90° by means of the handgrips 14*a* and 14*b* welded thereon.

Figure 5:
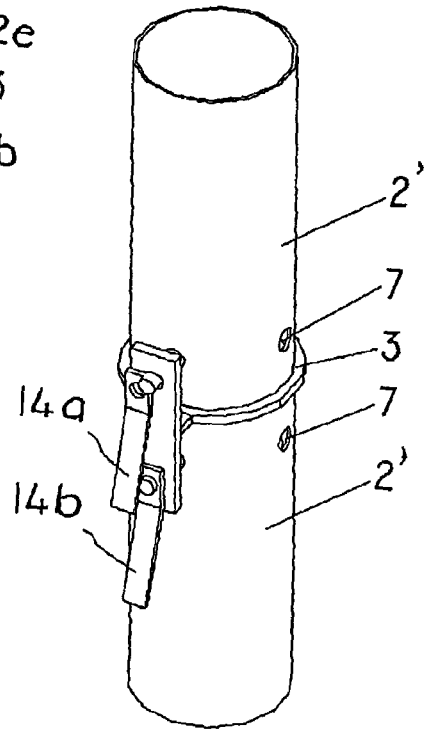
FIG. 5 is a perspective view of two upright elements interconnected by means of a connecting member.

According to FIG. 5 both locking pins 8*a* and 8*b* (here not clearly visible) are each fastened my means of handgrip 14 and are now pointing downwards, in such a way that upright elements 2' are interconnected with connecting piece 3 into a compact compound element.

Figure 6:
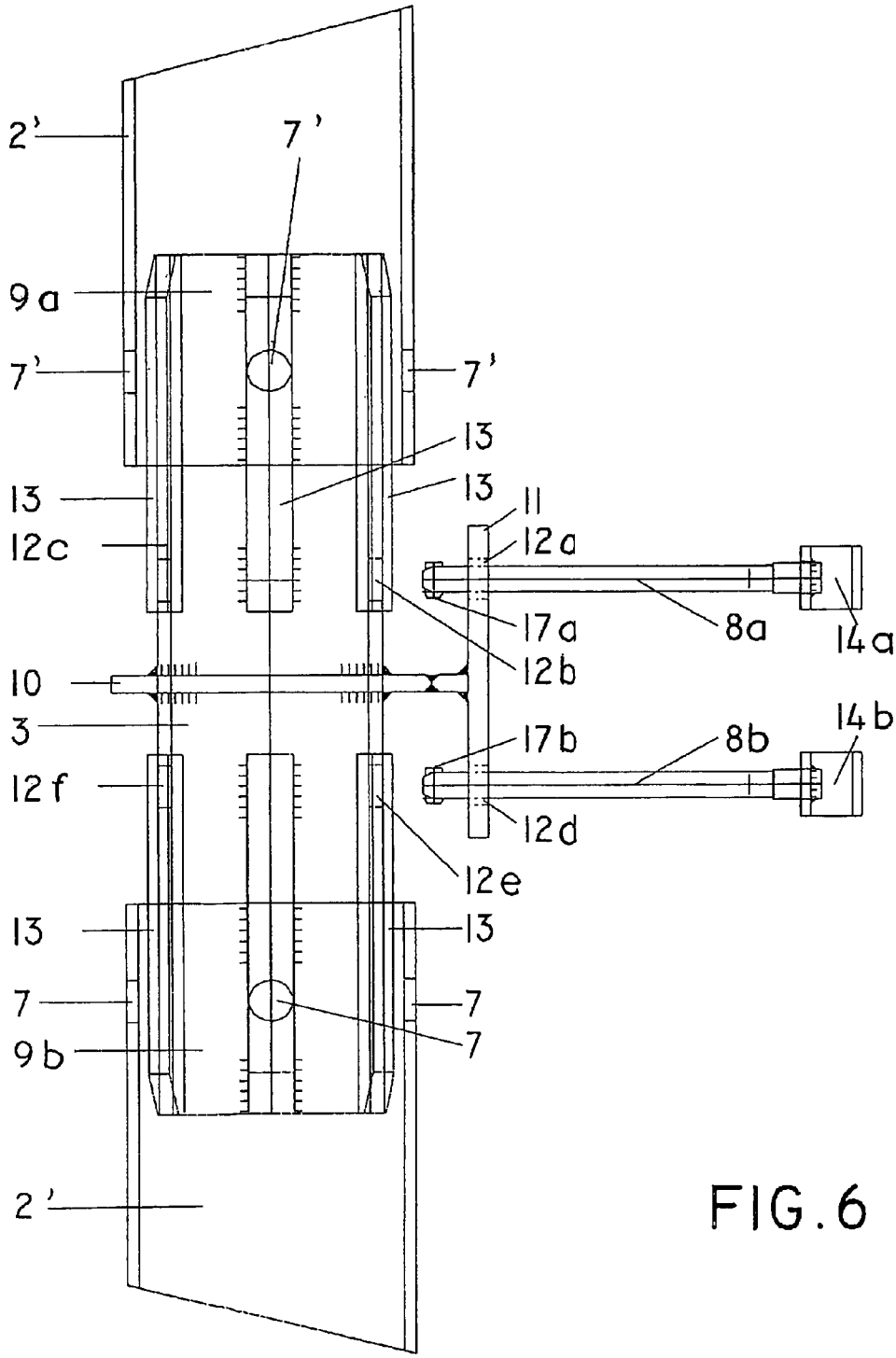
FIG. 6 is a side view of a connecting member and of two upright elements intercoupling.

FIG. 6 shows the mutual dimensional proportions between upright elements 2' and the connecting piece 3 positioned in between. The alignment of boreholes 12*a*, 12*b*, and 12*c* is shown in relation to the locking pin 8*a* on the upper part of connecting piece 3, and the alignment of boreholes 12*d*, 12*e* and 12*f* in relation to locking pin 8*b* at the bottom side respectively. When the upper positioned upright element 2' is completely mounted upon connecting piece 3 or on lower upright element 2' respectively, than on the one hand locking pin 8*a* and 8*b* are passed through boreholes 12*d*, 7, 12*e* and 12*f* and through boreholes 12*d*, 7, 12*e*, and 12*f* on the upper and bottom part and locked respectively. Locking pins 8*a* and 8*b* are comprising a specially shaped elongated body 16, which cross section has an elliptical shape, which locking pin 8*a* or 8*b* each at its free end (shown on the right) is provided with a handgrip 14 welded thereon and on the other free end (shown on the left) is provided with a so called round head rivet 17 for securing the connection between locking pin 8*a*, 8*b*, connecting piece 3 and vertical upright elements 2'; in such a way that undesired release of both locking pins 8*a* and 8*b* respectively and their removal from the sheet shaped pin holder 11 will not be possible during disassembling of the intended constructions and/or other operations as e.g. during transportation thereof.

Figure 7:
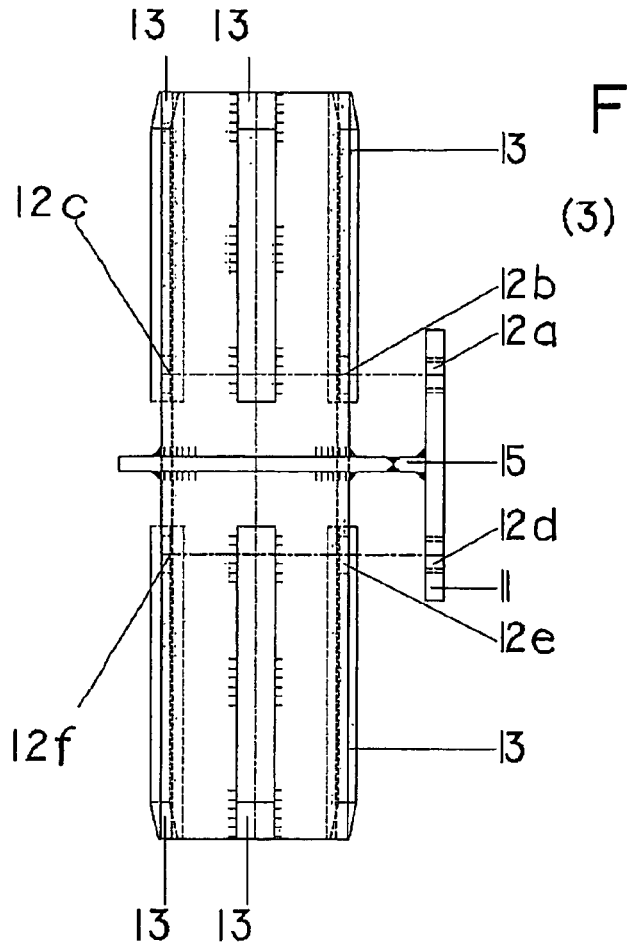
FIG. 7 is a side view of a connecting member.
Figure 9:
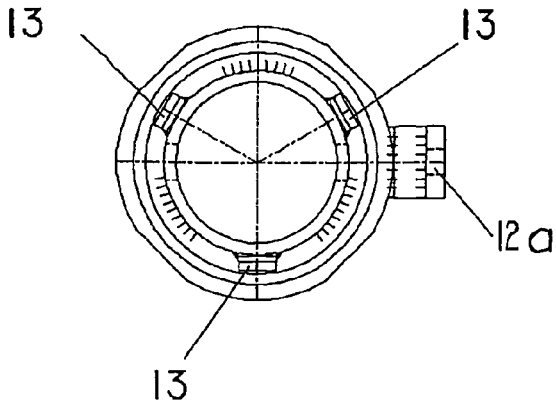
FIG. 9 is a top view of the connecting member.
Figure 10:
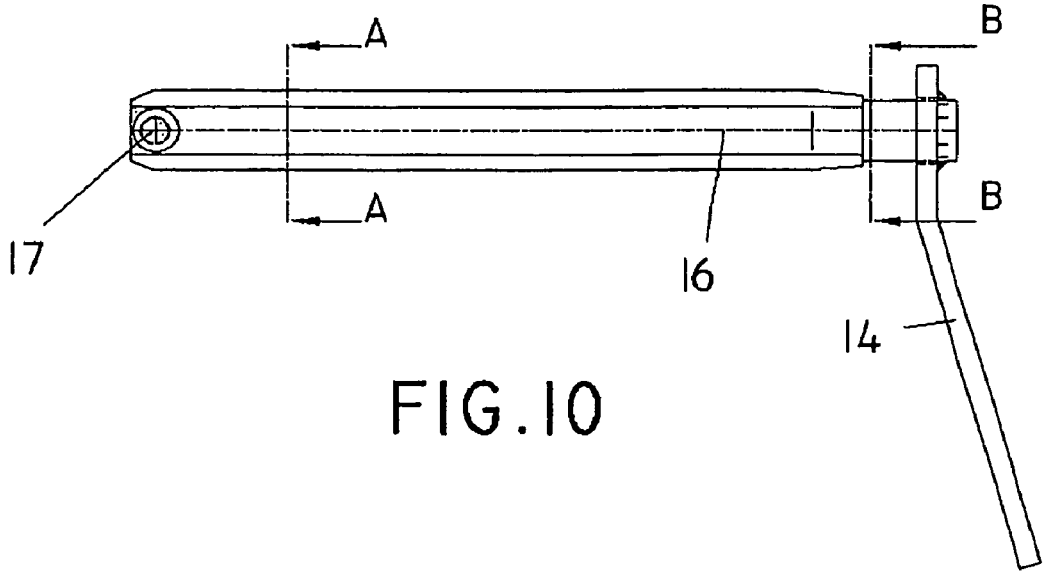
FIG. 10 is a view of a locking pin.

According to FIG. 7 (side view) and FIG. 9 (top view) the sheet shaped pin holder 11 is by means of an extension piece 15 welded thereon connected to the circular intermediate sheet 10. Horizontal and vertical alignment of the boreholes 12*a*, 12*b*, and 12*c* in upper position are shown and also the three boreholes 12*d*, 12*e*, and 12*f* in lower position.

Figure 8:
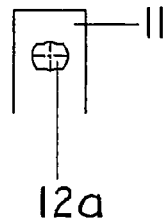
FIG. 8 is an enlarged detail of a connecting member.

FIG. 8 shows an enlarged detail of the free upper end of the sheet shaped pin holder 11. The special shape of borehole 12*a* serves for passing through and fastening respectively of the locking plate 8*a* (not shown). Borehole 12*d* (here not shown) having an identical shape as borehole 12*a* is positioned on the free lower end of the sheet shaped pin holder 11 for passing through and fastening respectively of the lower mounted locking pin 8*b* (not shown)

Figure 11:
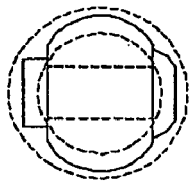
FIG. 11 is a cross section of a locking pin.
Figure 12:
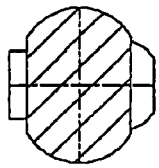
FIG. 12 is a cross section of a locking pin.
Figure 13:
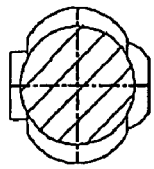
FIG. 13 is a cross section of a locking pin.

The cross sectional special elliptical shape of the locking pin 8*a* or 8*b* is shown on the one hand in a side view of the (left) free end in FIG. 11, further in a cross sectional view A-A of the central part in FIG. 12 and also in another cross sectional view B-B of a part nearby the handgrip 14 in FIG. 13. In FIG. 10-13 locking pin (8*a* or 8*b*) is shown firstly passing through aforesaid boreholes (12*a*, 12*b*, 12*c*, or 12*d*, 12*e*, 12*f*) if handgrip 14 is positioned under an angle of 90° with respect to the connecting piece (not shown) and the upright elements (not shown) respectively. The coupling of connecting piece 3 (not shown) with vertical upright element 7 (not shown) is realised by means of handgrips 14 of both locking pins 8*a*, 8*b*, by downward rotation under an angle of approx. 90° thereby wedging the elliptical shape of body 16 on the one hand in boreholes 12*b*, 7' and 12*c* and on the other hand in boreholes 12*d*, 7 and 12*f*.

Figure 14:
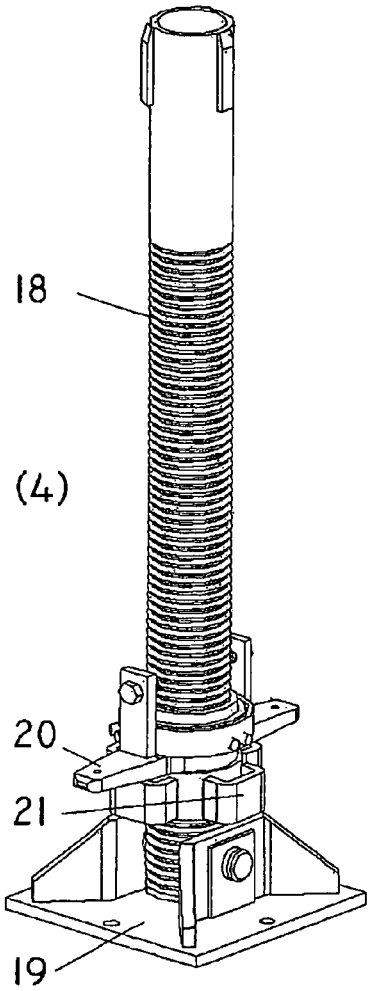
FIG. 14 is a perspective view of a spindle assembly.
Figure 15:
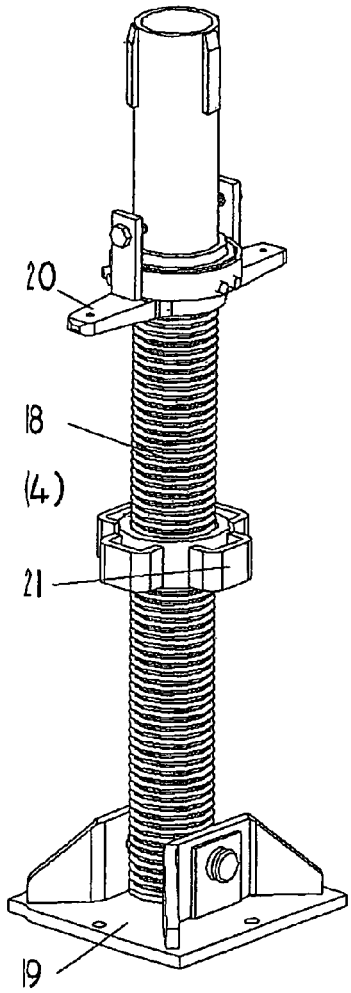
FIG. 15 is a perspective view of a spindle assembly.

According to FIG. 14 and FIG. 15, spindle 18, foot element 19, butterfly nut 20 and coupling piece 21 of a spindle assembly 4 are shown in assembled state. Further FIG. 14 shows the spindle assembly 4 in its lowest position, whereby butterfly nut 20 is located downward, nearby foot element 19. FIG. 15 shows the spindle assembly 4 in its highest position with butterfly nut 20 positioned upward, nearby the upper side of spindle 18.

Figure 16:
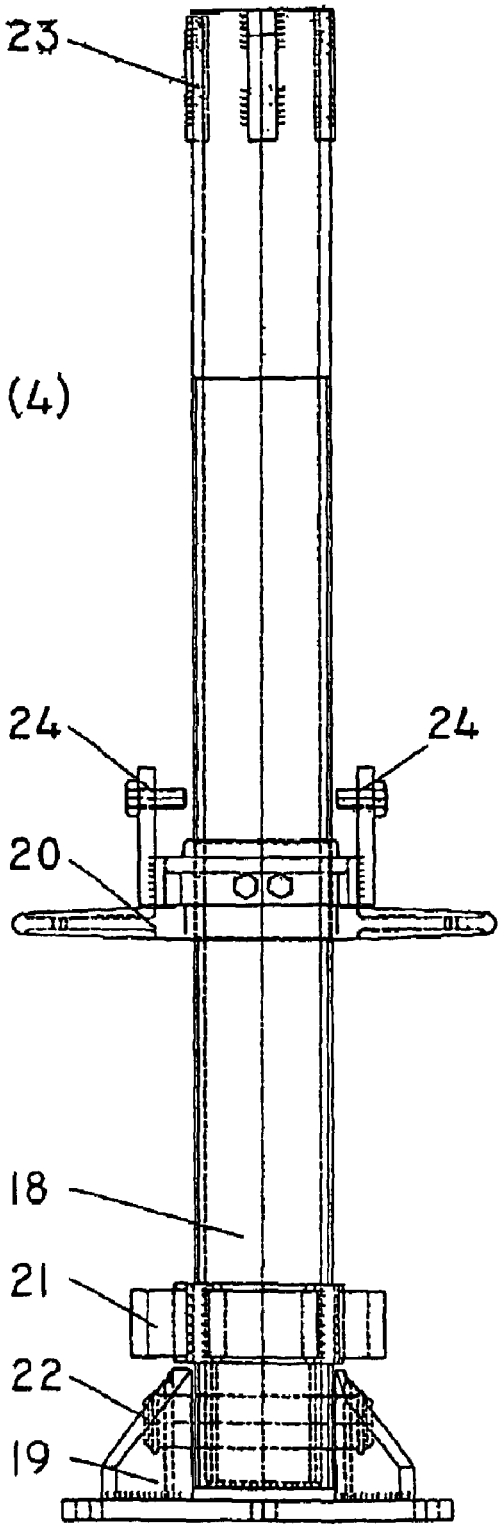
FIG. 16 is a frontal view of the spindle assembly.

The dimensional ratio between the spindle 18, foot element 19, and butterfly 20 and coupling piece 21 is shown in FIG. 16. On the outside of the free upper end of the spindle 18 guiding strips are provided for easy positioning or mounting of the free lower end of an upright element (not shown), which upright element is attached by means of locking screws 24 upon spindle assembly 4. The lower side of spindle 18 is anchored in foot element 19 by means of a solid locking pin 22.

Figure 17:
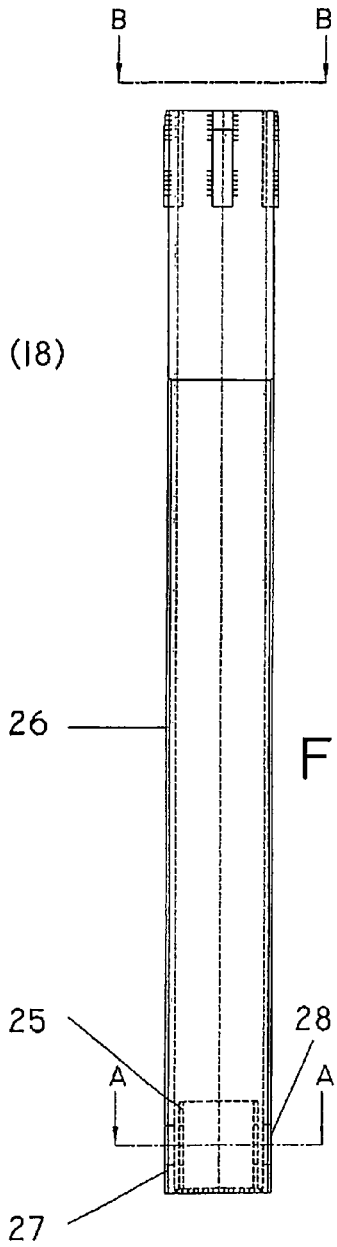
FIG. 17 is a frontal view of the spindle.
Figure 18:
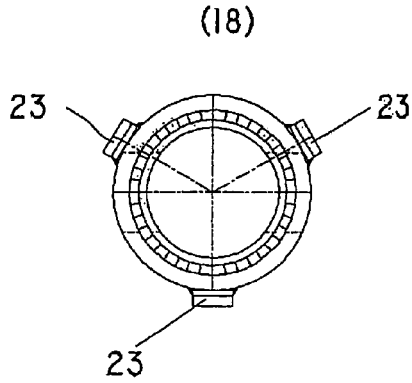
FIG. 18 is a cross section of the upper part of the spindle.
Figure 19:
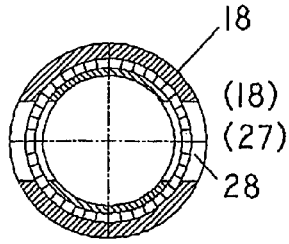
FIG. 19 is a cross section of the bottom part of the spindle.

According to FIG. 17 (frontal view) and also FIG. 18 (top view) spindle 18 is provided with three sheet shaped guiding strips 23, positioned under an angle of 120°, for internal concentric positioning and mounting respectively in the bottom end opening of a tube-shaped upright element (not shown). The outside of spindle 18 is provided over approx. ¾ of its total length with trapezoid threading 26 type TR 102×24.6 (3 G), which is capable of carrying a high load. According to FIG. 17 and FIG. 19 at the bottom part of the free lower bottom end opening of spindle assembly 18 a hollow tube element 25 is welded concentrically for reinforcement of anchor part 27 of spindle 18. Anchoring of spindle 18 to the foot element (not shown) is realised by means of a solid locking pin 22 (not shown) having an outer diameter of approx. 40 mm and a length of 180 mm. Aforesaid pin is passed through borehole 28, having a diameter of approx. 40 mm, firstly at axial distance of approx. 80 mm in relation to the free bottom end opening of spindle 18 and secondly passed through a suitable borehole in the foot element (not shown). Further the outward protruding free end of the locking pin 22 (not shown) is secured by means of a usual known locking clip (not shown) or the like.

Figure 20:
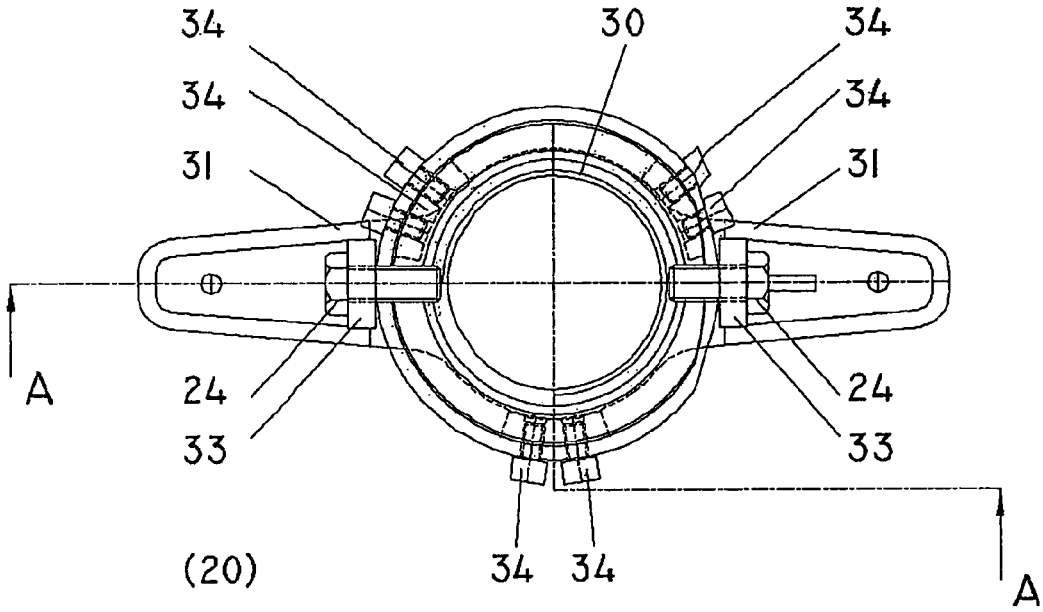
FIG. 20 is a top view of the spindle nut.
Figure 21:
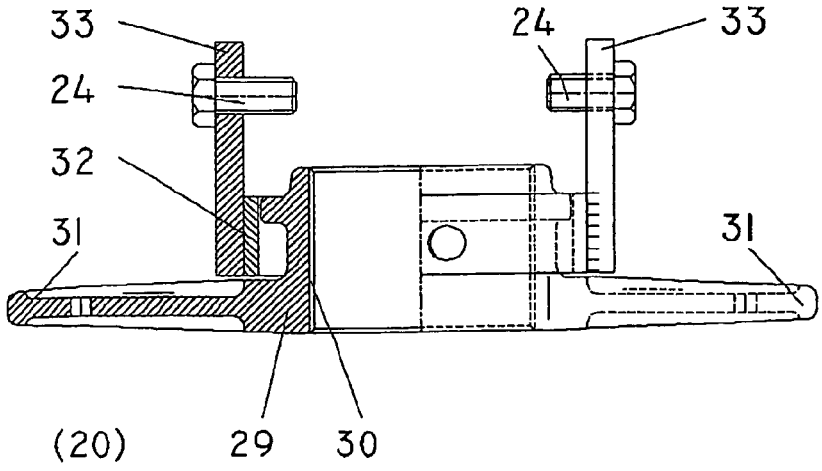
FIG. 21 is a cross section of the spindle/coupling nut.

According to FIGS. 20 and 21 butterfly nut 20 comprises a hollow cylindrical housing 29 provided with an internal trapezoid thread 30 type TR 102×24.6 (3 G), whereby the bottom part is provided with a set of handgrips 31 for height adjustment of the upright assembly (not shown). At the upper part of the hollow cylindrical housing 29 a free rotatable ring is mounted by means of three spacer screws 34 positioned under an angle of 120° with respect to each other. Free rotatable ring 32 is provided on its outside with a set of sheet shaped screw holders 33 welded thereto for locking screws 24 for anchoring in the bottom end opening of a tube-shaped upright element (not shown). Butterfly nut 20 is mounted resistant to tensile strain to the bottom part or the upper part of the upright element (not shown) thereby not blocking the rotation of the butterfly nut 20, i.e., height adjustment of the upright assembly.

Figure 22:
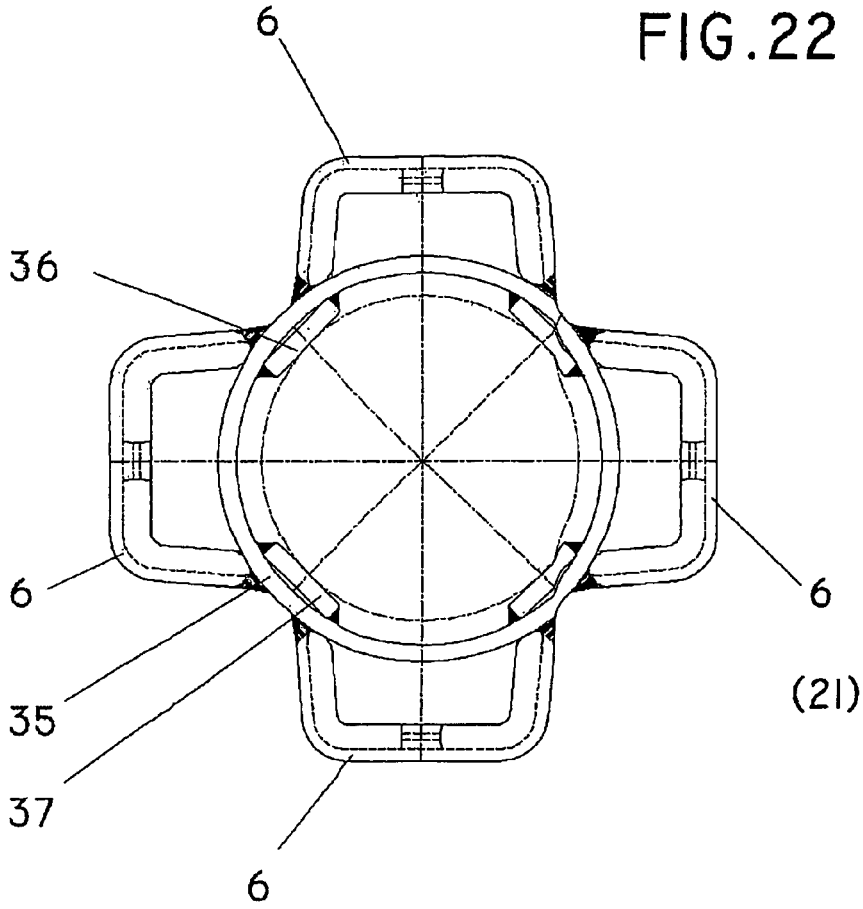
FIG. 22 is a top view of the coupling part of the spindle assembly.
Figure 23:
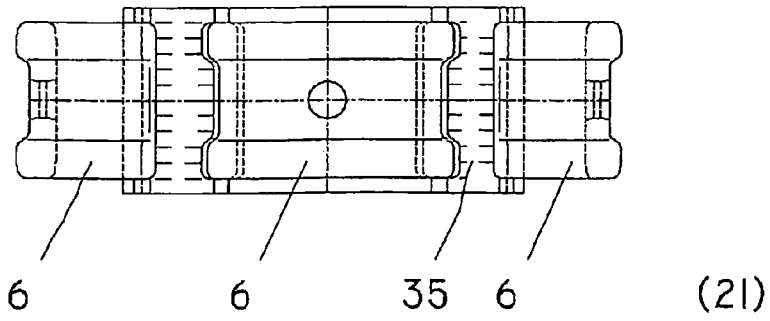
FIG. 23 is a frontal view of the coupling part of the spindle assembly.

According to FIGS. 22 and 23 coupling piece 21 comprises a hollow cylindrical housing 35 which internally is provided with four guiding strips 36 welded thereon on for vertical guidance on the spindle (not shown) and its outside is provided with four C-shaped coupling members 6 welded under an angle of 90° with respect to each other. These C-shaped coupling members 6 are identical to the C-shaped coupling members welded on the aforesaid upright elements 2' (not shown). An intermediate frame (not shown) may be coupled at the same time thereby considerably decreasing the free flexing length of the spindle assembly (not shown).

Figure 24:
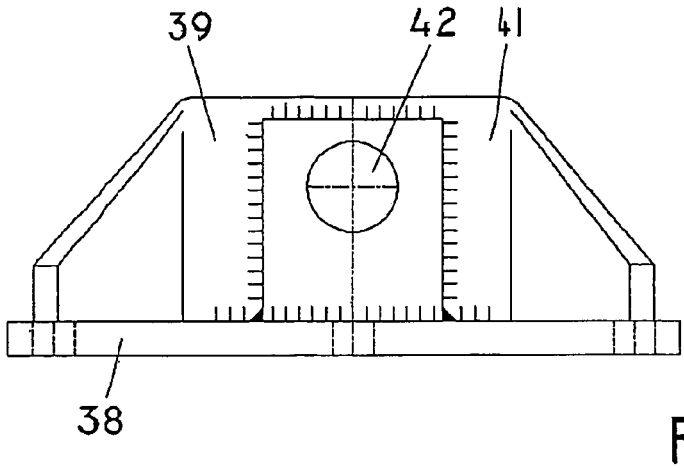
FIG. 24 is a frontal view of the foot element.
Figure 25:
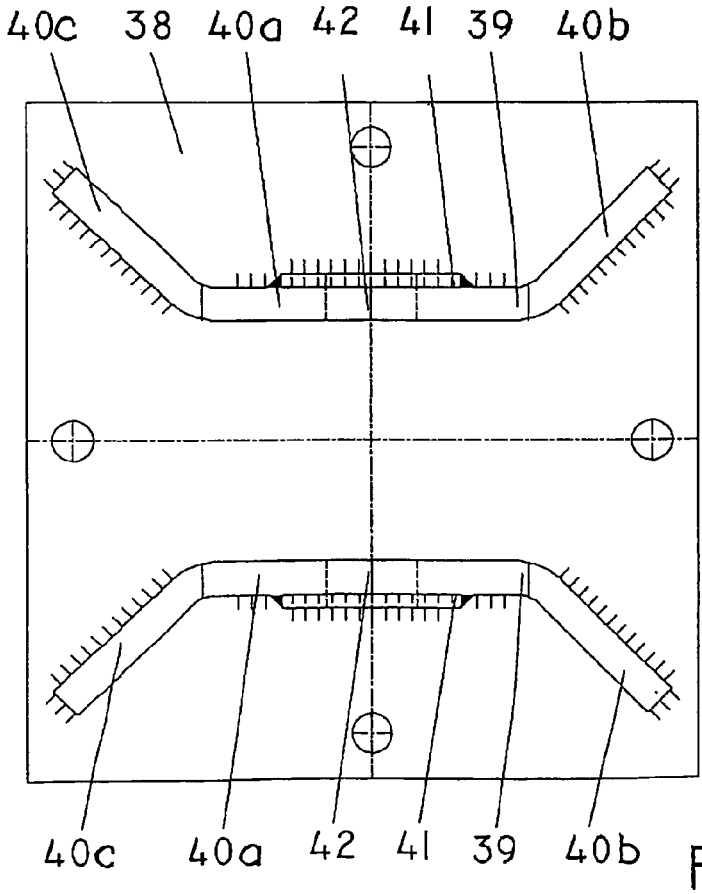
FIG. 25 is a top view of the foot element.

According to FIGS. 24 and 25 foot element 19 comprises a square shaped stell sheet 38 having a thickness of 15 mm and a longitudinal length of approx. 300 mm provided with two symmetrically positioned walls 39 welded thereon having a thickness of 15 mm. Each wall 39 is constructed from a rectangular central part 40*a* having a reinforcement sheet 41 welded thereon, both provided with a borehole 42. On both sides of the rectangular central part 40*a* of wall 39 there is provided, under an angle of approx. 135° inclined downwardly a cut or bent left part 40*c* and right part 40*b*. For anchoring the spindle (not shown) in the foot element 19 the solid locking pin 22 (not shown) is passed through the borehole 42 which having a diameter of approx. 40 mm and also is passed through the appropriate borehole in the spindle having an outer diameter of approx. 40 mm and a length of 180 mm.

Figure 26:
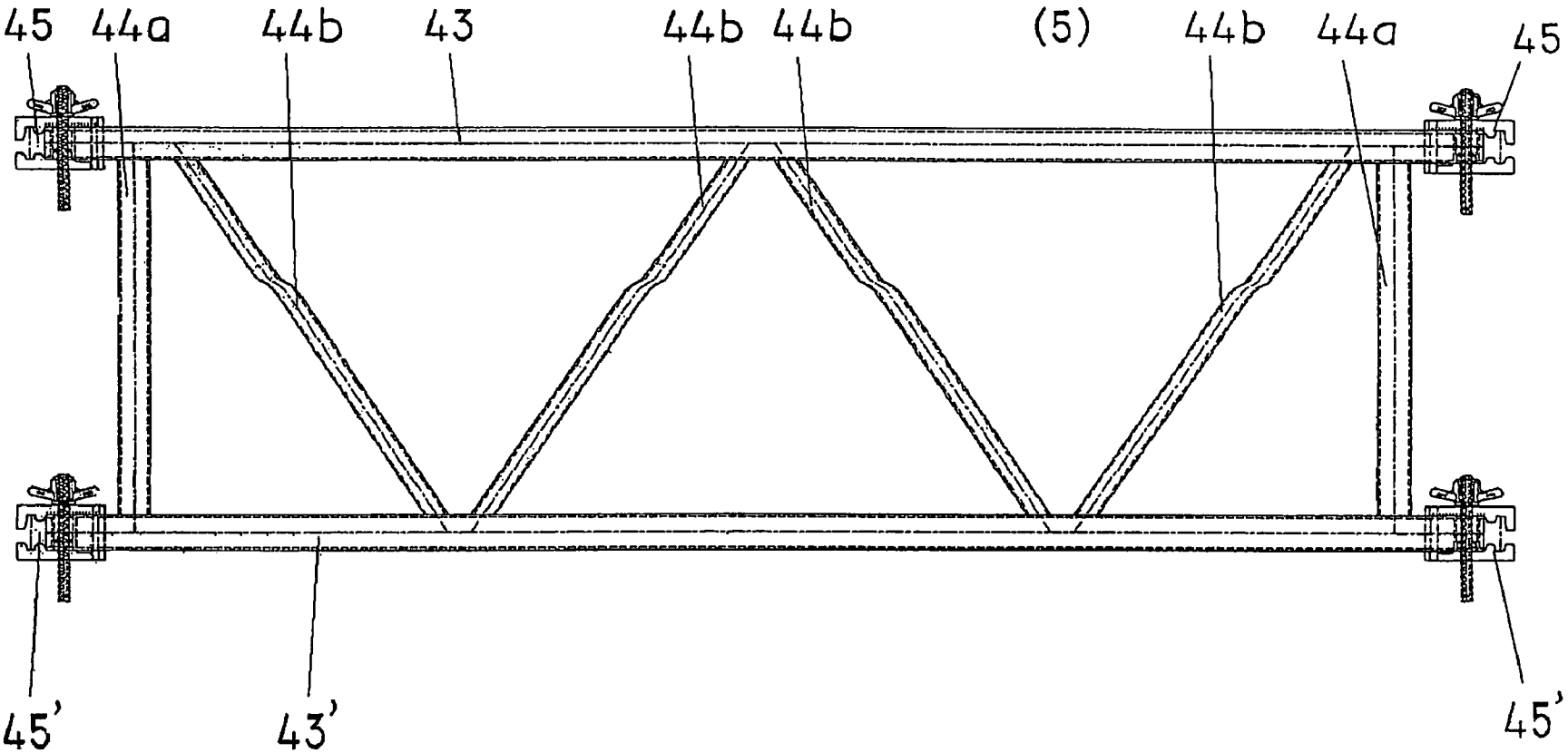
FIG. 26 is a front view of the intermediate frame.

According to FIG. 26 the intermediate frame 5 comprises two distantly spaced parallelly positioned horizontal girders 43 interconnected by means of vertical and/or inclined positioned frame elements 44*a*, 44*b*. Both free ends of upper girder 43 are each provided with a coupling device 45 and like the free ends of de-lower girder 43' are each provided with a coupling device 45' in such a way interconnecting the C-shaped coupling device (not shown) of an upright assembly (not shown).

Figure 27:
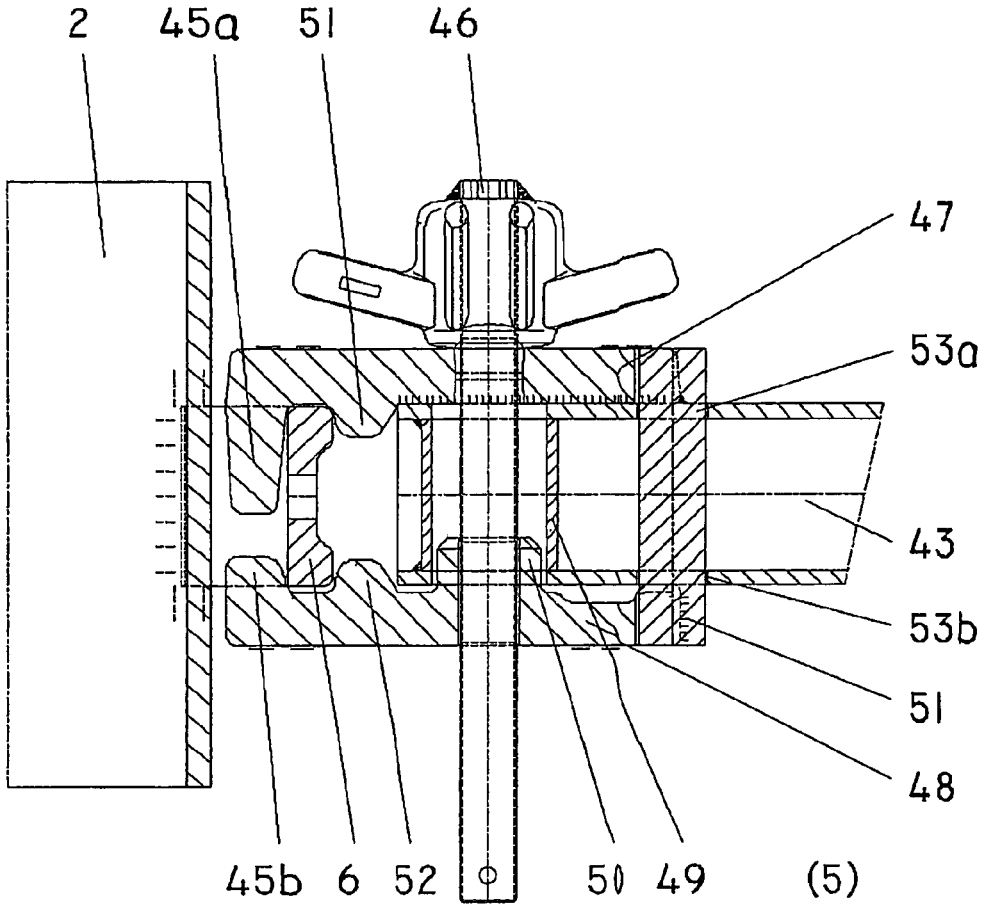
FIG. 27 is a cross section of the coupling assembly.

According to FIG. 27 girder 43 is internally provided with tube element 49 welded therein and also of boreholes 53*a* (upper part) and 53*b* (lower part). Upper claw 47, welded on the upper part of girder 43, is formed as a L-shaped sheet element whereby the longer part of the L is welded to the free upper end openings of horizontally positioned girders 43. The downwardly pointing short part of the L 45*a* and protrusion 51 respectively are formed for mounting and fixing upon a coupling part (not shown) of adjustable spindle assembly (not shown) on the C-shaped coupling means 6 of upright element 2. Lower claw 48 is shaped as an L-shaped sheet element with an upwardly pointing shorter part of the L 45*b*. The longer part of the L is provided with a protrusion 52 at a distance of its free end opening and with a hollow cylindrical bulge 50 provided with internal threading which corresponds to the threading of the screw member 46. By means of screw member 46 and guiding rod 51, passed through boreholes 53*a* and 53*b*, lower claw 48 is positioned and fixed respectively to C-shaped coupling member 6 of a coupling piece (not shown) of upright element 2 of the adjustable spindle assembly (not shown). For easy mounting of the intermediate frame 5 on an upright assembly 2 the downwardly pointing shorter part L 45*a* of the upper claw 47 of an upper positioned coupling device 45 is approx. 10 mm longer than the downwardly pointing short part of the L (not shown) of the upper claw of a lower positioned coupling device 45' (not shown).

Figure 28:
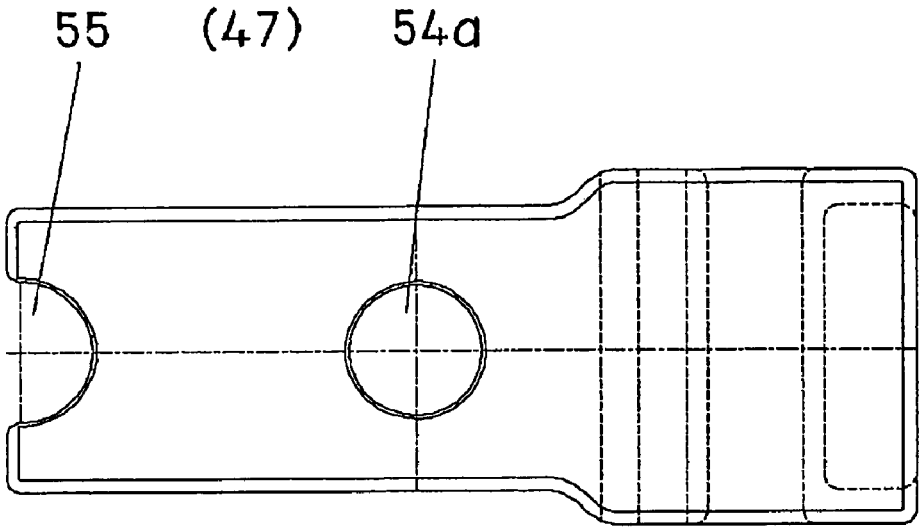
FIG. 28 is a to p view of the upper claw.
Figure 29:
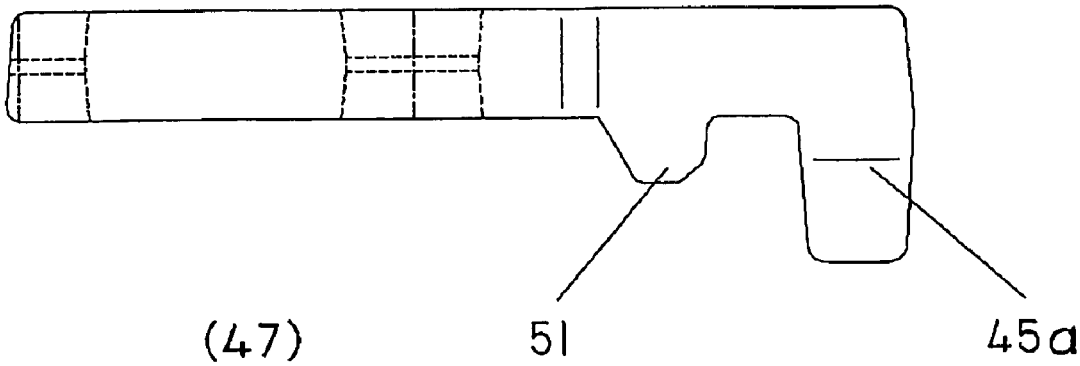
FIG. 29 is a side view of the upper claw.
Figure 31:
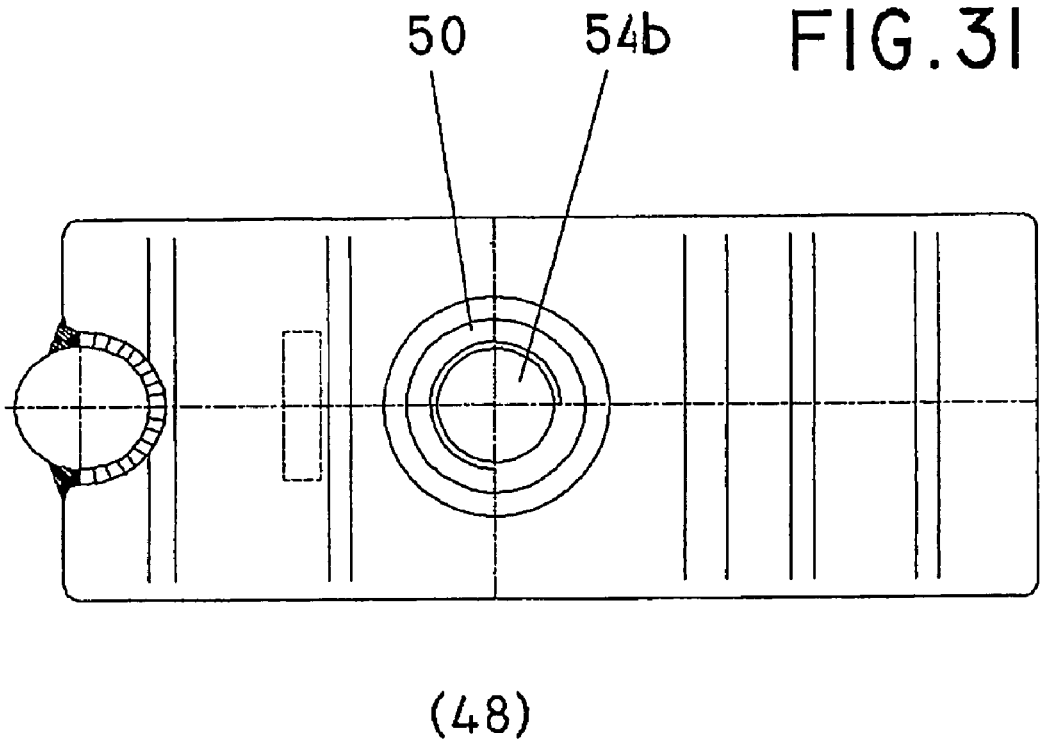
FIG. 31 is a top view of the lower claw.

FIGS. 28 (upper view) and 29 (side view) show both the same upper claw 47. Upper claw 47 is essentially shaped as an L-shaped sheet element with a downwardly pointing short part of the L, 45*a*. The longer part of the L is at a distance of its free end and at its lower part provided with a protrusion 51. Upper claw 47 is on its upper side provided with borehole 54*a* (without internal threading) having sufficient space for guidance of the screw member 46 (not shown). On the opposite free end of the upper claw 48 a semicircular opening 55 is provided for guidance of guiding rods 51 (not shown) of lower claw 48 (not shown).

Figure 30:
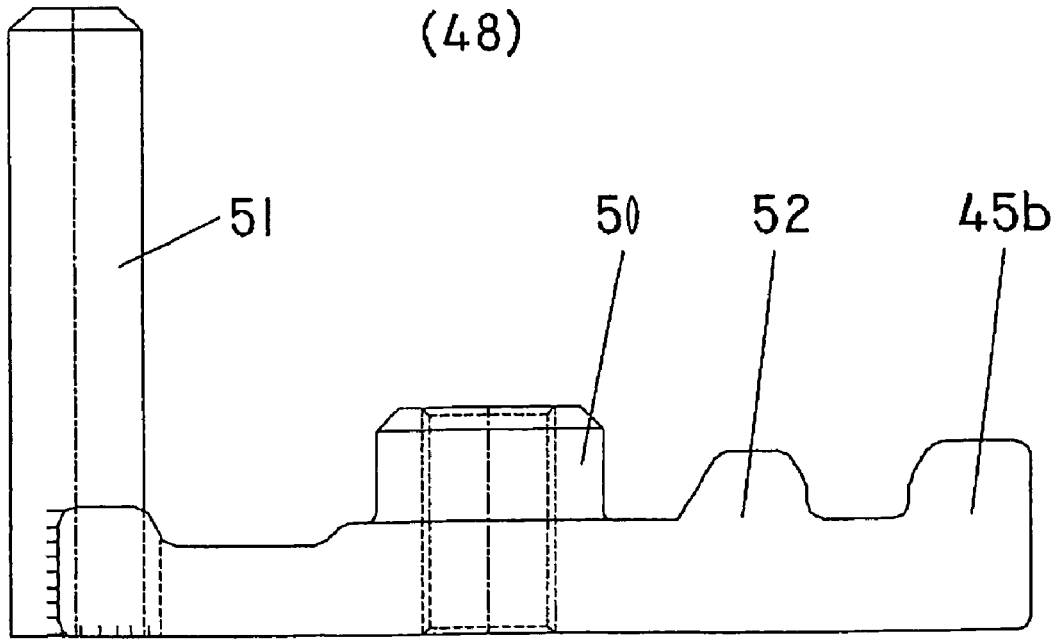
FIG. 30 is a side view of the lower claw.

FIGS. 30 (side view) and 31 (top view) each show the same lower claw 48. Upper claw 47 is essentially shaped as an L-shaped sheet element with an upwardly pointing shorter part of the L 45*a*. The longer part of the L is at a distance of its free end provided on its upper side with a bulge 52 and a cylindrical bulge 50 which is provided with internal threading which corresponds to the (external) threading of the screw means 46 (not shown). At its opposite free end the lower claw 48 is provided with guiding rod 51 welded thereto for guidance through the boreholes 53*a* and 53*b* (not shown) of a girder 43 (not shown).

Figure 32:
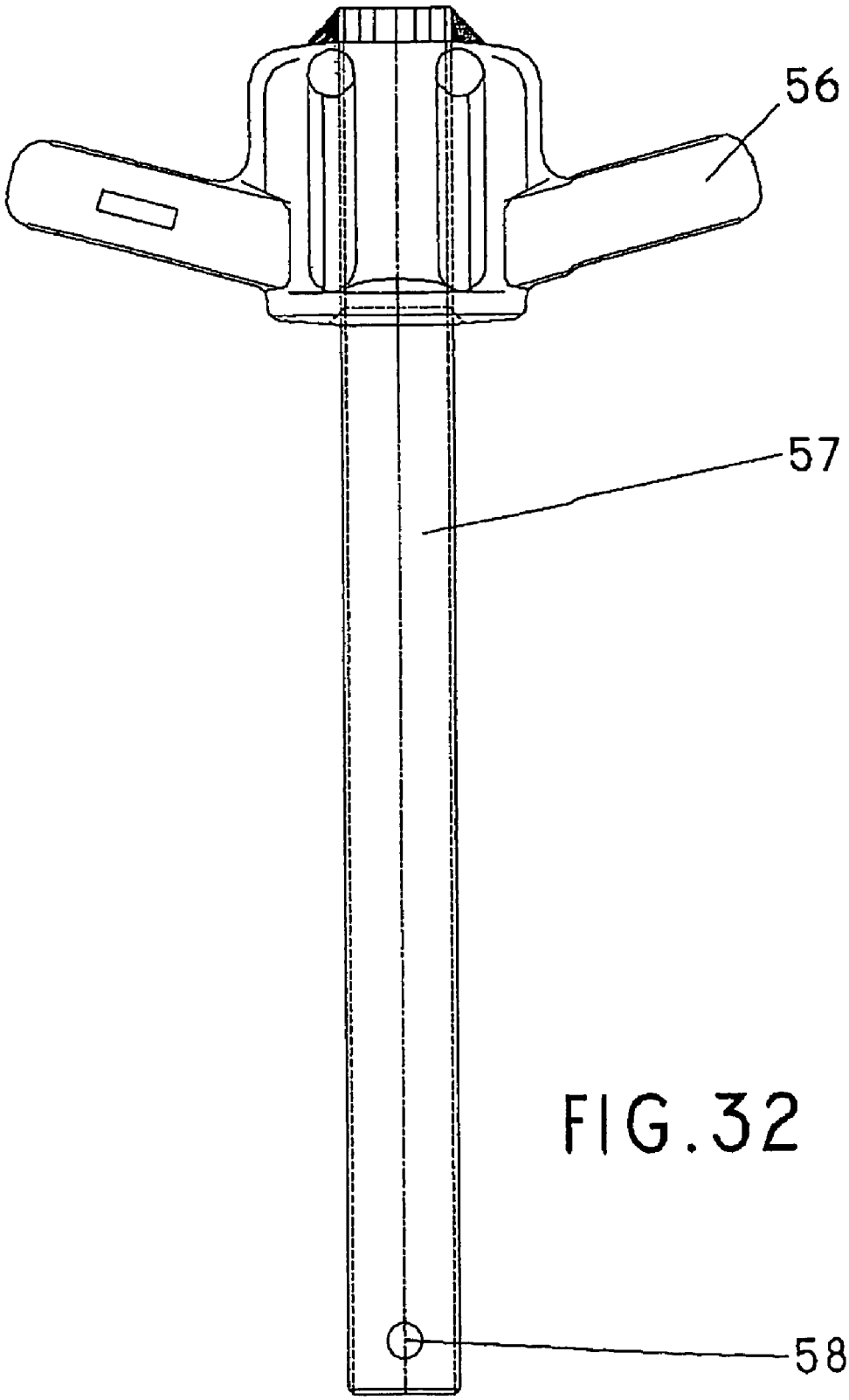
FIG. 32 is a side view of the screw means.

According to FIG. 32 screw means 46 comprises a cylindrical body 57 provided with a trapezoid thread type TR 17×10 26, capable of carrying a high load, and is with a butterfly nut 56 for screwing on and releasing thereof. Due to the robust design of cylindrical body 57 and butterfly nut 56 it is possible to achieve very high connecting forces between the claw assembly (not shown) and the C-shaped coupling piece e.g. manually or by means of a hammer. Moreover the cylindrical body 57 is provided with a borehole 58 at a certain distance with respect to the free bottom end opening for positioning of a locking pin (not shown).

Figure 33:
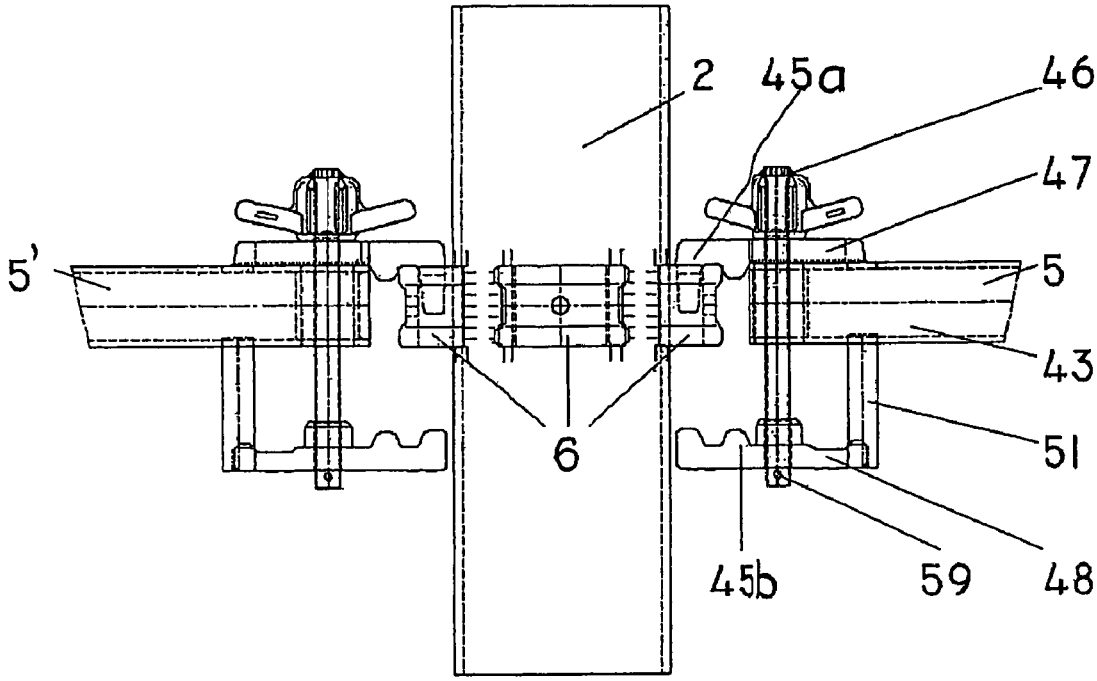
FIG. 33 is a side view of a detail of the coupling assembly in its open position.
Figure 35:
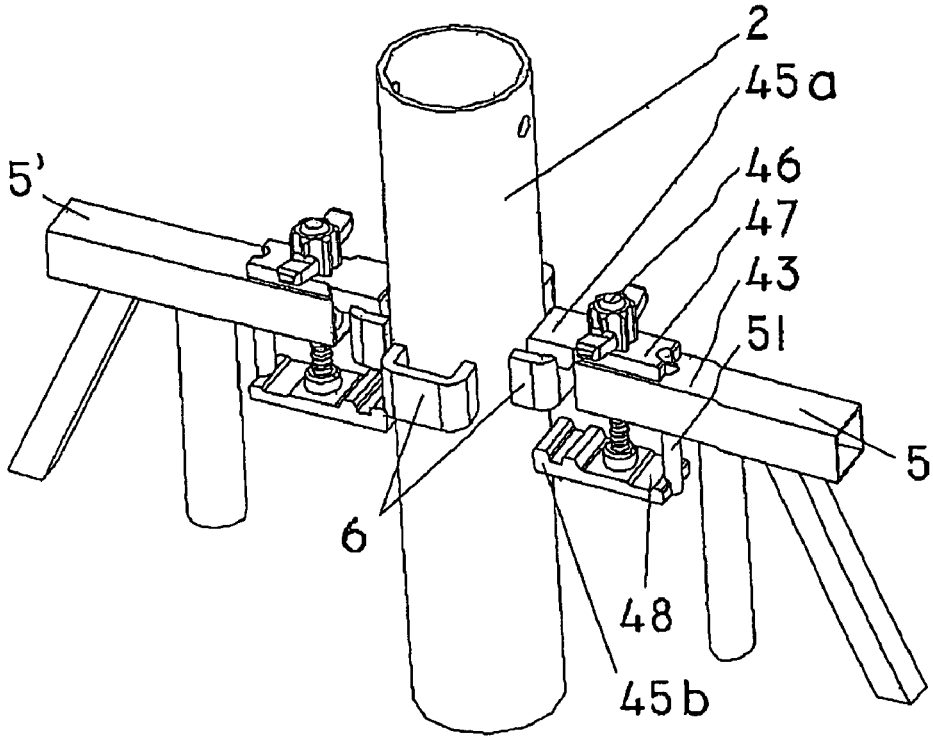
FIG. 35 is a perspective view of a detail of the coupling assembly in its open position.

According to FIG. 33 (side view) and FIG. 35 (perspective view) there is shown lower claw 48 in its opened position, in a pre-phase of the coupling of two intermediate frames 5 and 5' with upright assembly 2. Screw member 46 is now completely unscrewed whereby lower claw (48) is blocked at its bottom side by means of locking pin 59. Upper claw 47 is hooked onto C-shaped coupling means 6 whereto claw assembly 45*a*, 45*b* can be mounted by means of screw member 46. The lower part of guiding rod 51 of lower claw 48 is also visible.

Figure 34:
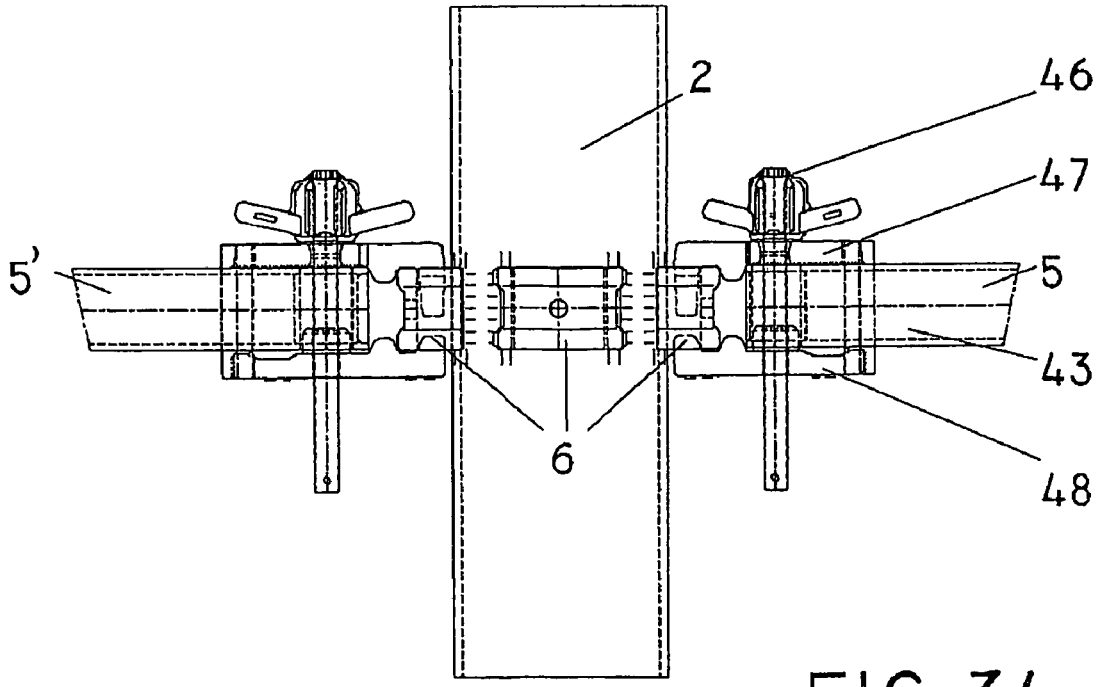
FIG. 34 is a side view of a detail of the coupling assembly in its coupled position.
Figure 36:
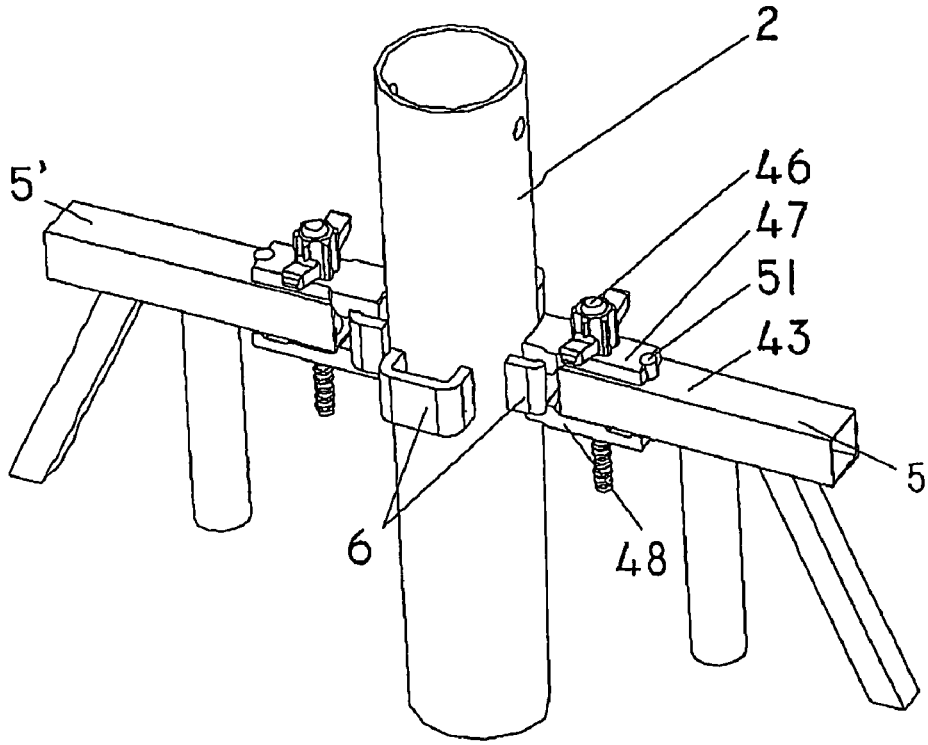
FIG. 36 is a perspective view of a detail of the coupling assembly in its open position.

According to FIG. 34 (side view) and FIG. 36 (perspective view) both intermediate frames 5 and 5' are now coupled and attached respectively to upright assembly 2. Screw means 46 is now completely screwed on and attached to respectively thereby fixing claw assembly 45*a*, 45*b* onto C-shaped coupling member 6. The upper part of the guiding rod 51 of lower claw 48 is here also visible.

In the above description the invention has been extensively explained by means of a preferred embodiment. It is clear that many variations are possible with respect to the choice of e.g. thread types, embodiment dimensions and shapes of parts like clay assemblies, butterfly nuts, connecting pieces etc. without falling outside the scope of the invention as described in the claims.

The invention claimed is:

1. Modular support system comprising:

at least four connected pairs of tube-shaped upright elements;

a plurality of C-shaped coupling members respectively positioned at a selected plurality of locations along the length of each upright element, wherein said plurality of C-shaped members at each selected location substantially encompass the circumference of the upright element;

at least one tube-shaped coupling member for mutually connecting each pair of upright elements at the ends thereof into a compact compound element;

at least one adjustable spindle assembly being mounted resistantly to tensile strain attached to the lower and/or upper side of an upright assembly, which spindle assembly is provided with a coupling and anti-flexure part which is also provided with a plurality of C-shaped coupling members substantially encompassing the circumference of the coupling part;

at least four intermediate frames for mutually interconnecting said connected pairs of upright elements, each intermediate frame comprising:

two mutually distantly spaced parallel horizontally positioned girders interconnected by means of lattice elements, whereby each of both free ends of a girder is provided with a coupling device which connects each of the four free ends of the intermediate frame with an adjacent vertical upright element and/or spindle assembly using said C-shaped coupling members, in such a manner, that the modular support system in its assembled position is transportable as a whole and adjustable in height.

2. An adjustable spindle assembly mounted to a tube-shaped upright element of a modular support system, the adjustable spindle assembly comprising:

a spindle provided with a thread being capable of carrying a high load, which is provided at its upper end with guiding strips serving for the inner concentric positioning and mounting of the spindle in a lower and/or upper end opening of the tube-shaped upright element, a foot element configured to position and anchor a free end of the spindle, the foot element comprising a foot plate which at its upper part is provided with welded vertical reinforcement plates and configured to anchor the free end of the spindle, a butterfly nut, mounted on the spindle, comprising a hollow cylindrical housing internally provided with screw thread while its bottom part is provided with a plurality of radially protruding handgrips for the adjustment of the upright assembly at the desired height and for fast dismounting by means of its rotation, having mounted on its top side a free rotatable ring, which on its outside is provided with a set of sheet shaped screw holders welded thereto for locking screws for anchoring into the lower end opening of the tube-shaped upright element, in such a way, that the butterfly nut may be mounted to the lower and/or upper side of the upright element without blocking the rotation of the butterfly nut, and a coupling and anti-flexure piece movably positioned on the spindle between the butterfly nut and the foot element and comprising a hollow cylindrical housing internally provided with guiding strips for its vertical guiding on the spindle, and further provided with four C-shaped coupling members welded on the outer circumference in such a way that in its mounted position one or more intermediate frames may be coupled up on the coupling parts and also on the upright elements thereby considerably reducing the free flexing length of the spindle, in such a way, that the modular support system in its assembled position may be adjusted in height and also may be subjected to a high stress.

3. A coupling assembly for use in coupling of intermediate frames on spindle assemblies of a modular support system, the coupling assembly comprising:

at least one coupling device comprising at least an upper claw and a lower claw, each positioned on all four free ends of said intermediate frames; which upper claw in a cross section is constructed as an L-shaped sheet element whereby the longest portion of the L is welded upon the free upper end of the horizontally positioned girders of the intermediate frame and the shorter part of the L is pointing downward, whereby the lower claw is formed as a loose L-shaped sheet element provided with a hollow cylindrical protrusion being internally threaded and a guide for positioning or centering thereof whereby each lower claw is fixed by a screw member against the free lower side of the horizontally positioned girders of the intermediate frame, which at a certain distance from their free end openings are each internally provided with a guiding tube element for guiding the lower claw;

C-shaped coupling members, positioned on upright elements and/or coupling parts of the spindle assemblies, whereby the inside of said coupling members offers sufficient space for locating therein the specially shaped free end of the upper claw and also the specially shaped free end of the lower claw for intercoupling of the intermediate frames with the upright elements; and corner struts in an inclined position on two adjacent intermediate frames near the free upper openings thereof;

such that each of the four free end openings of the intermediate frame may be connected into a strong, stable and robust unit with an adjacent other vertical upright clement and/or spindle assembly, while preventing twisting of the modular support system in its assembled position.

4. A system for mutually coupling two upright elements of a modular support system, the system comprising:

a tube-shaped connecting member comprising a tube profile provided with one or more guides for internal mounting into the upright elements and a ring disposed substantially half way along the length of the tube profile and having a greater outer diameter than the upright element has; and a locking member for locking the connecting member to the upright elements, wherein the connecting member is provided with pass through openings for receiving a locking pin in such a way that the lower end of the locking member is mounted from the upside down into an upright element until the ring, whereafter on its upper end a next upright element is located and locked respectively by means of locking pins each with a non-circular oblong body in cross section, which locking pins are each provided with a handgrip which is positioned at a certain mutual distance by means of a perforated rectangular plate welded on said ring, and whereby said mutual distance corresponds to the mutual distance between the passing through openings on both ends of the connecting member and the passing though openings of two upright elements one positioned upon the other in mounted position; which locking pins are each provided with a round head rivet for securing the connection between the locking pin and with the connecting piece and also with the vertical upright elements in such a way that an undesired release of both locking pins and their removal from the sheet shaped pin holder will not be possible.

5. The modular support system of claim 1, wherein the tube-shaped upright element is constructed in steel of standard lengths of 1200 mm, 1800 mm, 2400 mm, 3000 mm, having an outer diameter of approx. 135 mm, and having of a wall thickness of approx. 6 mm and being loadable to approx. 250 kN.

6. The coupling assembly of claim 1, wherein the C-shaped coupling and anti-flexure members are constructed from steel C-profile having a length of approx. 50 mm and a thickness of approx. 10 mm.

7. The coupling assembly of claim 3, wherein the downwardly pointing short part of the L of the upper claw of the coupling device which is positioned on the upper girder of the intermediate frame is approx. 10 mm longer than the downwardly pointing short part of the L of the upper claw of a coupling device which is positioned on the lower girder of the intermediate frame.

8. The coupling assembly of claim 3, further comprising a screw member having an oblong screw body having a length of approx. 200 mm and a pitch of approx. 10 mm, and is provided on its upper side with a butterfly nut for screwing on manually or by means of a suitable tool.

9. The modular support system of claim 1, wherein the intermediate frames are manufactured in standard lengths of 1200 mm, 1800 mm, 2400 mm, 3000 mm.

10. The adjustable spindle assembly of claim 2, wherein the outer diameter of the spindle is approx. 100 mm by a length of the spindle of approx. 1200 mm, approx. ¾ of the total length is provided with quadratic or trapezoid threading, with a pitch of approx. 25 mm, capable of taking high loads,

11. The adjustable spindle assembly of claim 2, wherein the foot element further comprises a solid locking pin having an outer diameter of approx. 40 mm and a length of approx. 180 mm, and a tube element for internally reinforcing of the bottom side of the spindle, whereby said solid locking pin, passing through a borehole having a diameter of approx. 40 mm, is mounted at a distance of approx. 80 mm with respect to the centre of a free bottom end opening of said spindle and further through a borehole positioned at a distance of approx. 70 mm with respect to the centre of the free upper end opening of said foot element whereby the outwardly extending end of the locking pin is locked by means of a locking clip.

12. The adjustable spindle assembly of claim 2, wherein the foot element further comprises a square shaped steel plate with a thickness of approx. 15 mm and having a side length of approx. 300 mm and having two symmetrical positioned vertical walls welded thereon each having a thickness of approx. 15 mm, each side wall comprising rectangular central part, provided with a reinforcement plate welded thereupon having a borehole, located on both sides of the rectangular central part of the wall and under an angle of approx. 135° inclined downwardly.

* * * * *

UNITED STATES PATENT AND TRADEMARK OFFICE

CERTIFICATE OF CORRECTION

PATENT NO. : 7,516,590 B2
APPLICATION NO. : 10/522129
DATED : April 14, 2009
INVENTOR(S) : Frans Brinkmann It is certified that error appears in the above-identified patent and that said Letters Patent is hereby corrected as shown below:

Column 9, Lines 64 to 65, please delete "clement" and insert therefore, --element--.

Column 10, Line 40, please delete "clement" and insert therefore, --element--.

Column 10, Line 65, please delete "though" and insert therefore, --through--.

Column 12, Line 5, please delete "loads," and insert therefore, --loads.--.

Column 12, Line 17, please delete "element" and insert therefore, --element,--.

Signed and Sealed this

Twenty-ninth Day of December, 2009

David J. Kappos

David J. Kappos
*Director of the United States Patent and Trademark Office*